United States Patent [19]

Schacht

[11] Patent Number: 4,516,867

[45] Date of Patent: May 14, 1985

[54] PRINTING WHEEL CONNECTING AND ADJUSTING MEANS

[76] Inventor: Roy A. Schacht, 744 Des Peres Rd., St. Louis, Mo. 63131

[21] Appl. No.: 421,300

[22] Filed: Sep. 22, 1982

[51] Int. Cl.[3] ..... B41J 1/54

[52] U.S. Cl. ..... 400/175; 400/134; 74/571 M

[58] Field of Search ..... 400/175, 174, 134, 134.1, 400/134.2, 134.3, 144, 144.4, 144.3, 144.2; 101/248, 286, 110; 474/900, 902, 903; 74/571 M; 403/DIG. 4, DIG. 6

[56] References Cited

U.S. PATENT DOCUMENTS

| | | | |
|---|---|---|---|
| 1,418,461 | 6/1922 | Pierce, Jr. | 74/440 |
| 3,482,512 | 12/1969 | Jung | 101/110 |
| 3,516,352 | 6/1970 | Lewis | 101/248 |
| 3,785,470 | 1/1974 | Schacht | 400/134.1 |
| 4,084,507 | 4/1978 | Sato | 101/110 |
| 4,229,111 | 10/1980 | Schact | 400/303 |
| 4,261,788 | 4/1981 | McClung | 403/DIG. 6 |
| 4,289,231 | 9/1981 | Kaminski | 474/900 |
| 4,322,173 | 3/1982 | Schact | 400/303 |
| 4,347,005 | 8/1982 | Lendl | 400/144.3 |
| 4,363,559 | 12/1982 | Suzuki et al. | 400/175 |

FOREIGN PATENT DOCUMENTS

| | | | |
|---|---|---|---|
| 158971 | 12/1980 | Japan | 400/175 |
| 2027394 | 2/1980 | United Kingdom | 400/175 |

*Primary Examiner*—Edgar S. Burr
*Assistant Examiner*—M. J. Hirabayashi
*Attorney, Agent, or Firm*—Glenn K. Robbins

[57] ABSTRACT

A marking machine having a printing wheel with printing characters on the periphery of the wheel. Adjustment means are provided for adjusting the rotational position of the wheel with respect to a drive shaft comprising a drive train connecting the printing wheel to the drive shaft. The printing wheel is rotatable with respect to the drive shaft but may be fixed by an intermediate backing plate member which is keyed to the drive shaft. An adjustable eccentric rotatably connected to the printing wheel has an eccentric shaft element fitting in a slot in the backing member to provide rotable adjustment of the printing wheel with respect to the drive shaft. The printing wheel may be slipped on and off the shaft and is secured to the drive shaft by a hub-like handle member having a spring radially biased ball detent receivable within a groove on the end of the drive shaft to facilitate ready connection and removal of the printing wheel. The dimensioning of the groove having camming sides from a stop on the drive shaft firmly biases the printing wheel against the stop.

4 Claims, 11 Drawing Figures

PRINTING WHEEL CONNECTING AND ADJUSTING MEANS

BACKGROUND OF THE INVENTION

In the past various types of marking machines have been employed for marking on work pieces such as metal or plastic tags of one nature or another. Such marking machines of the kind concerned in this invention have printing characters on the periphery of the marking wheel and are driven by a drive shaft to rotate the printing or marking wheel to a position where the selected printing character is directly superimposed over the work piece at which time the wheel or the work piece are caused to contact one another to effect the marking operation. Such marking machines are exemplified in my U.S. Pat. Nos. 4,322,173; 4,229,111 and 3,785,470.

Problems have been presented in such machines for adjusting the relative rotational position of the selected printing characters with respect to the work piece. Since the printing wheel is conventionally fixed to the drive shaft rotational alignment has been difficult. Such alignment to effect proper adjustment requires only a few degrees in relative rotation but can necessitate time consuming and complex adjustment.

A further problem has involved difficulty in removing the printing wheel to effect repair from time to time and in the past has involved the use of tool and considerable down time in the change-over operation.

SUMMARY OF THE INVENTION

By means of this invention there has been provided a simple adjusting means for effecting a slight degree of rotation of the printing wheel with respect to the drive shaft. The adjustment may be effected directly upon the printing wheel to correct any slight off-centering of the marking characters on the printing wheel in the marking position.

The adjusting means is comprised of a drive train from the drive shaft through a backing plate member fixed to the shaft and an eccentric means connecting the backing plate member to the printing wheel. The eccentric means may be simply adjusted from the front of the printing wheel to move in a slight degree of rotation the printing wheel with respect to the backing plate member.

The backing plate member may be simply fixed to the drive shaft by fitting the drive shaft through an opening in the plate member and then wedging the plate member in a tapered opening section into opposed grooves on the drive shaft.

The eccentric adjustment means is effected by a wheel adjustment shaft fitting through and rotably journalled in the printing wheel. A plate-like clamp member if formed at a rear end of said adjustment shaft and may be clamped to the wheel by a tightening nut of the like on a front end of the adjustment shaft. An eccentric shaft is off-set axially from the adjustment shaft and extends to the rear of the plate-like clamp member and is receivable with a radially extending slot in the backing plate member.

By the afore-described drive connection rotational adjustment of the printing wheel may be simply effected by loosening the clamp nut and rotating the end of the adjustment member clockwise or counterclockwise. Since the printing wheel is slidably mounted on the drive shaft and the eccentric shaft is slidably fitted within the slot of the backing plate member the printing wheel may be rotated to the desired position of adjustment. After the adjustment has been effected the clamping nut is tightened to provide the adjusted drive train.

Further, by means of this invention a simply devised and operated quick change connection has been provided to connect the printing wheel to the drive shaft. This connection is effected through a hub-like handle fixed to the printing wheel and having an opening slidably receiving a free forward end of the drive shaft. The handle has a radially spring biased ball detent which is engageable within a semi-circular cross-sectional groove formed on the periphery of the drive shaft. The groove is positioned at a predetermined distance from a stop member on the drive shaft against which the printing wheel is designed to abut to provide a camming action by the ball member urged against a curved side of the groove.

By means of the ball detent construction the printing wheel may be simply grasped by the handle and pulled off the end of the drive shaft. The axial force effected by the pulling movement causes the ball detent to move out of the groove and facilitate ready removal for any necessary repair or replacement.

The above features are objects of this invention. Further objects will appear in the detailed description which follows and will be otherwise apparent to those skilled in the art.

For the purpose of illustration, a preferred embodiment is shown in the accompanying drawing. It is to be understood that the drawing is for purpose of example and that the invention is not limited thereto.

IN THE DRAWING

DESCRIPTION OF THE INVENTION

Figure 1:
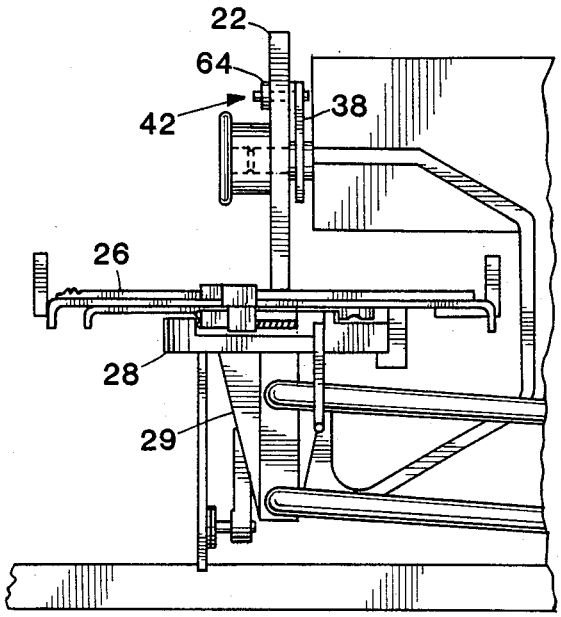
FIG. 1 is a fragmentary view in elevation of the right side of the front portion of the marking machine of this invention.
Figure 2:
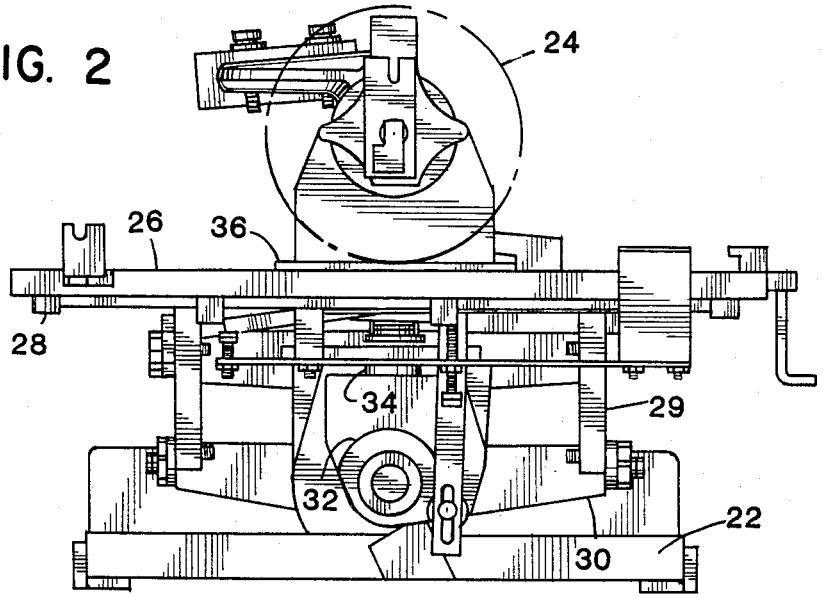
FIG. 2 is a view in front elevation of the machine.
Figure 4:
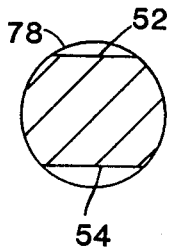
FIG. 4 is a view in section taken on the line 4—4 of FIG. 3.
Figure 3:
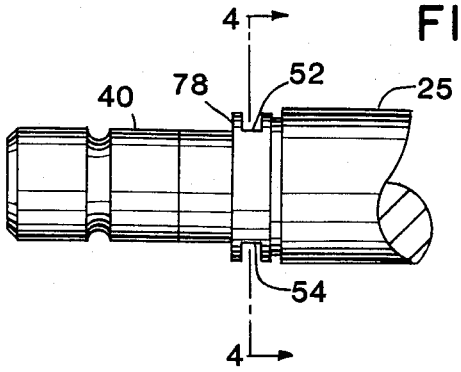
FIG. 3 is an enlarged view in side elevation of the front portion of the marking wheel shaft.

The marking machine of this invention is generally indicated by the reference numeral 20 in FIGS. 1 and 2. It is comprised of a base 22, a (motor not shown), a printing or marking wheel 24, a work table 26 and a key-board, (not shown) for operation of the machine 20.

The printing wheel 24, as well as the work table 26 and key-board are the same general construction as described in my U.S. Pat. Nos. 3,785,470; 4,229,111 and 4,322,173. Thus the printing wheel 24 has printing characters on its periphery and is driven by a shaft 25 connected to the motor (not shown) through appropriate drive means which form no part of this invention.

The work table 26 is supported upon a carriage casting 28 and is pivotally supported on the machine 20 by a yoke 29 and pivot bar connection 30. The carriage casting 28 is raised and lowered against the biasing action of springs by the revolution of a rotary cam 32 which contacts a thrust bar 34 at the bottom of the carriage casting 28 which supports the table 26. The cam 32 is connected to a camshaft which is driven only one revolution in a single marking operation. Appropriate circuitry is provided between the key-board and the various components to effect the operation of the marking wheel 24 and the camshaft as fully described in my aforementioned patents. The aforementioned components are fully described therein and form no part of the instant invention, per se, and are not deemed necessary to be shown in the drawing except as indicated.

The work table 26 is supported upon a carriage casting 28 as best shown in FIGS. 1 and 2. The general relationship of the carriage casting 28 and the work table 26 is similar to that shown in my aforementioned U.S. Patents. Thus the carriage casting 28 is moved up and down responsive to movement of the rotary cam 32 and makes a single revolution in a marking operation. The work table 26 which is supported upon the carriage casting 28 and moves with it, is also disengaged for transverse movement so as to advance a work tag 36 or the like which is held upon it for further marking operations. A support of the carriage casting 28 for the vertical movement is provided by yoke members 29 which are pivotally connected to the pivot bar members 30.

Figure 5:
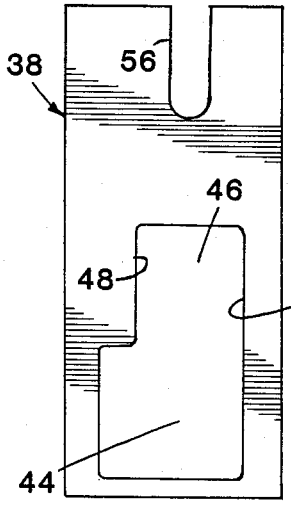
FIG. 5 is a plan view of the marking wheel backing plate.
Figure 6:
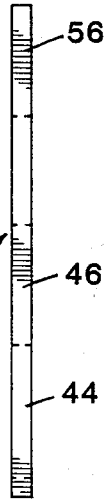
FIG. 6 is a view in right side elevation of the marking plate.
Figure 10:
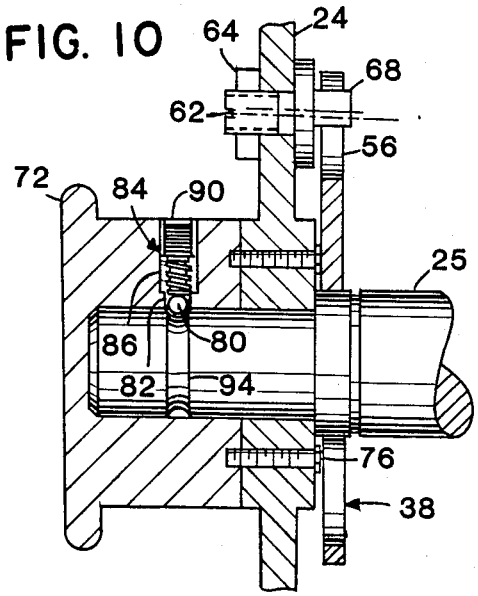
FIG. 10 is a view partly in axial section taken in elevation from the right side of the marking wheel and shaft showing the adjustment thereof against the backing plate.

The printing wheel 24 is provided with means for rotatably adjusting it with respect to the drive shaft 25 to correct any offset of the printing characters on the periphery of the drive shaft. This adjustment means is accomplished through a drive train connecting the printing wheel to the shaft through a backing plate member 38 as best shown in FIGS. 5, 6 and 10. The printing wheel is slidably mounted on a reduced diameter end portion 40 of the shaft and is adjustably fixed to the backing plate by an adjustable eccentric member 42 as best shown in FIGS. 8, 9 and 10.

The backing plate 38 is formed of rigid steel plate material and has an enlarged opening 44 in order that it may be fitted over the end portion 40 of the drive shaft. A reduced opening 46 is formed at an end portion of the enlarged opening which is adapted to permit the wedging of the backing plate to the drive shaft. The wedging or keying connection is provided by a slightly tapering lead-in provided by the rounded corner between the openings 44 and 46 leading to sides 48 and 50 of the opening which are adapted to be press-fitted in opposed flat bottomed grooves 52 and 54 of the drive shaft as best appears in FIG. 10. The backing plate forms a tight press-fit since the reduced opening or slot 46 is slightly smaller that the distance between the flat grooves 52 and 54. The backing plate is made of metal and heat treated so as to spring a small amount when press-fitted over the flat grooves of the drive shaft.

The backing plate is further provided with a slot 56 which received the eccentric adjustment member 42 to complete the drive train connection fixing the printing wheel in relation to the drive shaft. The slot 56 is positioned parallel to the sides 48 and 50 of the wedging opening of the backing plate to provide an elongated radial aspect to the drive shaft.

Figure 8:
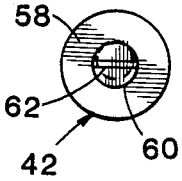
FIG. 8 is a front view in elevation of the adjustment pin.
Figure 9:
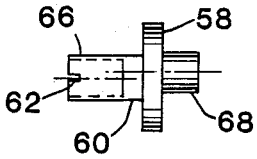
FIG. 9 is a right side elevational view of the adjustment pin.

The adjustable eccentric member 42 is shown in FIGS. 8, 9 and 10. It is comprised of a circular base 58 which is adapted to be clamped to the rear of the printing wheel. An adjustment shaft 60 extends forwardly of the base and is slidably fitted with an opening in the printing wheel. The front end of the adjustment shaft is provided with a diametric slot 62 which receives a tool such as a screwdriver or the like for rotating the adjustment shaft to turn the printing wheel with respect to the drive shaft as will more fully appear hereinbelow. A tightening nut 64 is threadably received on a threaded end portion 66 to effect the clamping relation of the base 58 against the printing wheel.

Extending from the rear of the base 58 is a eccentric shaft or dog 68 which is slidably fitted within the slot 56 of the backing plate. The eccentric shaft is axially offset in relation to the adjustment shaft as best appears in FIGS. 8, 9 and 10. The eccentric shaft will slide up or down within the slot when the adjustment shaft is rotated clockwise or counterclockwise as the case may be to effect any correctional turning of the printing wheel with respect to the drive shaft for centering of the printing characters on the periphery of the printing wheel.

Figure 7:
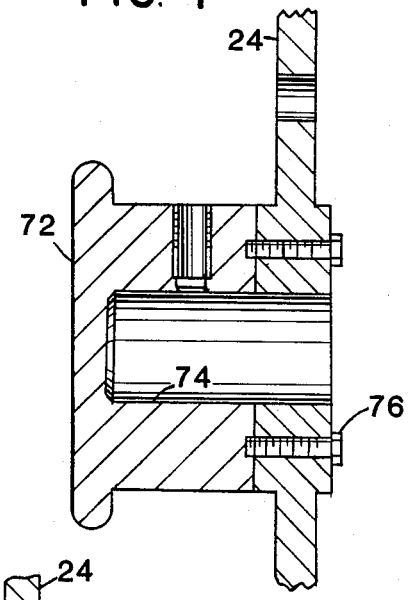
FIG. 7 is a fragmentary view in axial cross-section of the marking wheel and hub.
Figure 11:
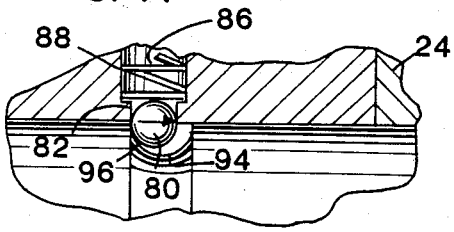
FIG. 11 is an enlarged fragmentary view of a portion of FIG. 10 showing the bearing relationship of the ball detent in the shaft groove.

A quick release mechanism is provided for the printing wheel which not only enables the printing wheel to be quickly removed and slipped back on the end of the drive shaft but also ensures a firm biasing against a shoulder of the drive shaft to prevent any wobbling in the operation of the marking machine. This mechanism is generally identified by the reference numeral 70 and is best shown in FIGS. 7, 10 and 11. It is comprised of a hub-like handle member 72 having an opening 74 receiving the reduced diameter end 40 of the drive shaft. The handle is appropriately secured to the printing wheel 24 such as by bolts 76.

The thus secured wheel may be urged against a shoulder 78 of the drive shaft by an axial thrust biasing and quick release ball detent mechanism comprised of a ball member 80 which is received in close sliding relation in a reduced diameter portion 82 of a radial bore hole 84 formed in the handle 72. A biasing spring 86 is seated in a middle portion 88 of the bore hole and is urged against the top of the ball member by a cap screw 90 received in a top threaded portion 92 of the bore hole.

As best shown in FIGS. 10 and 11, the ball member is seated within a circumferential groove 94 formed on the end 40 of the drive shaft. The groove has a semi-circular cross-section of a slightly larger diameter than the bore portion 92 in order that the ball may contact the curved side 96 to provide an axial thrust of the handle and printing wheel in the direction of the arrow in FIG. 11 against the drive shaft shoulder 78. The dimensioning of the center of the groove from the shoulder 78 is slightly less than the center of the ball detent from the back of the printing wheel in order to provide the aforementioned relationship.

The ball detent structure as above described performs the multiple faction of a quick release for the printing wheel and a firm biasing action to stabilize the printing wheel against the shoulder of the drive shaft while permitting relative rotation of the printing wheel with the drive shaft to effect the correctional adjustment of the printing wheel to the drive shaft.

USE

The backing plate drive train and adjustable printing wheel are very simply installed upon the drive shaft. The backing plate 38 is simply fitted over the free end 40 of the drive shaft through the large part 44 of the opening inthe backing plate. The sides 48 and 50 of the offset smaller portion 46 of the opening are then moved into registry with the flat bottomed grooves 52 and 54 of the drive shaft. The backing plate is then forcefully moved into wedging relation upon the drive shaft. It will be understood that instead of providing the sides 48 and 50 in tapering relation the flat bottomed grooves may be tapered as desired to effect the wedging action.

Once the backing plate has been installed the connected printing wheel and handle are easily fitted over the free end 40 of the drive shaft. The ball detent 80 which may be retained upon the spring by any conventional universal connection is depressed by the end of the drive shaft until the wheel is urged against the shoulder stop 78 of the drive shaft at which point the ball "popps" into the groove 94. Because of the predetermined distancing of the groove from the stop the ball 80 rests against the rounded camming surface 96 of the semi-circular cross-sectional groove and due to the downward biasing force of the detent spring 86 the wheel is urged firmly against the shoulder stop. The wheel may be freely rotated in this position with respect to the drive shaft to effect any correctional adjustment and may also be simply removed for repair or replacement with another wheel.

In the aforementioned assembly the interfitting of the adjustable eccentric member in the backing plate is effected by lining up the eccentric shaft 64 with the slot 56 of the backing plate 38. This ensures that as the wheel is slipped into complete engagement with the drive shaft and as the ball detent is engaged with the retaining groove of the drive shaft that the eccentric shaft engages the backing plate slot.

Should any slight rotational adjustment of the printing wheel be required the clamping nut 64 is loosened and the slot 62 of the adjustment shaft is engaged with a screwdriver or the like tool to turn the adjustment shaft. Since the eccentric shaft 68 is "captured" in the slot 56 of the backing plate which is fixed to the stationary drive shaft and can only move up or down the printing wheel is caused to turn with respect to the drive shaft, clockwise or counterclockwise depending on the turning direction of the adjustment shaft. Once the desired rotational adjustment has been effected the clamping nut 64 is tightened and the drive train from the drive shaft through the backing plate, adjustable eccentric and the printing wheel is restored for operating the marking machine.

Various changes and modifications may be made in the invention as will be readily understood by those skilled in the art. Such changes and modifications are within the scope of the invention as defined by the claims appended hereto.

What is claimed is:

1. A marking machine having a printing wheel with printing characters supported on a periphery of the wheel, means for supporting the wheel upon a drive shaft, means for rotating the drive shaft and wheel to a selected position to move a character on the wheel in a printing position over a work piece, the improvement comprising means for rotatably adjusting the wheel independently of the shaft, said means comprising a support means on said shaft and eccentric means supported upon the wheel and engageable with said support means, said eccentric means being moveable to adjust said wheel in a rotated position with respect to said shaft to adjust the printing position of said characters with respect to said workpiece, said support means comprising a backing member fixed to said drive shaft, said wheel being slidably mounted on said drive shaft and said eccentric means connecting said wheel and said backing member to provide a drive train from said drive shaft to said wheel, said eccentric means comprising a wheel adjustment shaft element rotatably journalled in said wheel and an eccentric shaft rotatably journalled in said backing member and means for rotating said wheel adjustment shaft element to provide for relative movement between said backing member and said drive shaft with respect to said wheel to rotatably adjust the wheel with respect to said drive shaft, said eccentric shaft being connected to a plate-like member which plate-like member is in abutting relation against an interior surface of said wheel and said eccentric shaft extending from said plate-like member to said backing member and a tightening element receivable on an exterior end of said wheel adjustment shaft element in clamping relation against said eccentric means and said wheel.

2. A marking machine having a printing wheel with printing characters supported on a periphery of the wheel, means for supporting the wheel upon a drive shaft, means for rotating the drive shaft and wheel to a selected position to move a character on the wheel in a printing position over a work piece, the improvement comprising means for rotatably adjusting the wheel independently of the shaft, said means comprising a support means on said shaft and eccentric means supported upon the wheel and engageable with said support means, said eccentric means being moveable to adjust said wheel in a rotated position with respect to said shaft to adjust the printing position of said characters with respect to said work piece, said support means comprising a backing member fixed to said drive shaft, said wheel being slidably mounted on said drive shaft and said eccentric means connecting said wheel and said backing member to provide a drive train from said drive shaft to said wheel, said backing member comprising an elongated member slidably receivable in wedging relation on said drive shaft, said elongated member having a substantial rigidity to be press-fitted upon said drive shaft and to provide a stable support, said elongated member being provided with an enlarged opening receiving said shaft, said enlarged opening communicating with a reduced opening, said enlarged and reduced openings having a tapered lead-in therebetween, said reduced opening and said tapered lead-in defining a wedging opening within which said shaft is wedgeable to a fixed position.

3. The marking machine of claim 1 in which said backing member is provided with a slot-like opening closely receiving in slidable relation said eccentric shaft.

4. The marking machine of claim 2 in which said drive shaft is provided with a groove means receiving the tapered edged of said rigid elongated member.

* * * * *